US007644970B2

(12) United States Patent
Chui et al.

(10) Patent No.: US 7,644,970 B2
(45) Date of Patent: Jan. 12, 2010

(54) MOBILE CONTAINERIZED AUTOPSY FACILITY

(75) Inventors: Peng Sun Paul Chui, Singapore (SG); Weng Tim Chong, Singapore (SG); Weng Kai Chong, Singapore (SG)

(73) Assignees: Health Sciences Authority (SG); Acre Engineering PTE Ltd (SG)

( * ) Notice: Subject to any disclaimer, the term of this patent is extended or adjusted under 35 U.S.C. 154(b) by 132 days.

(21) Appl. No.: 10/576,984

(22) PCT Filed: Oct. 23, 2003

(86) PCT No.: PCT/SG03/00251

§ 371 (c)(1),
(2), (4) Date: Nov. 28, 2006

(87) PCT Pub. No.: WO2005/040528

PCT Pub. Date: May 6, 2005

(65) Prior Publication Data

US 2007/0132262 A1 Jun. 14, 2007

(51) Int. Cl.
*A61G 3/00* (2006.01)

(52) U.S. Cl. ..... 296/24.38

(58) Field of Classification Search ..... 296/19, 296/24.38

See application file for complete search history.

(56) References Cited

U.S. PATENT DOCUMENTS 4,743,059 A 5/1988 Legueu
4,850,268 A * 7/1989 Saito et al. ..... 454/341
4,858,256 A * 8/1989 Shankman ..... 296/19
5,195,635 A * 3/1993 Cornwell ..... 206/366
5,727,353 A * 3/1998 Getz et al. ..... 296/19
6,082,799 A * 7/2000 Marek ..... 296/24.38
6,601,894 B2 * 8/2003 Shaw ..... 296/24.38

FOREIGN PATENT DOCUMENTS

FR 2819536 1/2001

OTHER PUBLICATIONS

PCT International Preliminary Report, for Health Sciences Authority et al., Int'l App'l No. PCT/SG2003/000251, Filed Oct. 23, 2003, Dated Sep. 29, 2005.

PCT International Search Report for Health Sciences Authority et al., Int'l App'l No. PCT/SG2003/000251, Filed Oct. 23, 2003, Dated Jan. 5, 2004.

PCT Written Opinion of the International Searching Authority for Health Sciences Authority et al., Int'l App'l No. PCT/SG2003/000251, Filed Oct. 23, 2003, Dated May 11, 2005.

* cited by examiner

*Primary Examiner*—Lori L Lyjak
(74) *Attorney, Agent, or Firm*—Law Offices of Albert Wai-Kit Chan, PLLC

(57) ABSTRACT

A mobile containerized autopsy facility for use in distant contamination zones, comprising at least one enclosure which includes at least one seamless and sealable compartment, which compartment meets biohazard safety level 3 and 4 requirements. The facility consists of enclosures that are most commonly a conversion of at least one standard 40×8×9.5 foot refrigerated cargo container that may be easily transported by trailers or by air to remote sites and be operational without the dependence on local infrastructure.

20 Claims, 4 Drawing Sheets

MOBILE CONTAINERIZED AUTOPSY FACILITY

This application is a National Stage Application of International Application No. PCT/SG2003/000251, filed Oct. 23, 2003, the contents of the preceding application are incorporated by reference into this application.

FIELD OF THE INVENTION

This invention relates to a mobile autopsy facility. In particular, the invention relates to a mobile containerized autopsy facility that integrates all features necessary to meet the requirements of handling Biohazard Safety level (BSL) 3 and 4 hazards during an autopsy, particularly in remote locations.

An autopsy is a systematic examination of a dead body. This process might subject the pathologist and his or her assistants to a wide variety of infectious agents including blood-borne and aerosolized pathogens such as human immunodeficiency virus (HIV), hepatitis B and C viruses, *Mycobacterium tuberculosis*, Severe Acute Respiratory Syndrome (SARS) and other deadly viruses. Other hazards include toxic chemicals (e.g., formalin, cyanide, and organophosphates) and radiation from radionuclides used for patient therapy and diagnosis. These risks can be substantially mitigated through proper assessment, personal protective equipment, appropriate autopsy procedures and facilities design.

Biohazard safety levels have been clearly established for biomedical and microbiologic laboratories with the same levels and principles now being introduced to autopsy facilities. Safety guidelines for autopsy personnel indicate that any autopsy can potentially harbor a risk to personnel for BSL 2, 3 or 4 classified agents.

BSL-2 provides personal protection against the majority of blood-borne pathogens. BSL-2 associated practices form part of the standard hygienic procedures and precautions applied to normal medical operations within health-care facilities.

BSL-3 procedures provide protection to health-care participants in an environment of risk to harmful agents spread by aerosols, e.g. *Mycobacterium tuberculosis*, rabies and *Y. pestis*. BSL-3 principles are suitable for work with indigenous or exotic agents that can cause serious or potentially lethal disease as a result of exposure by the inhalation route.

BSL-4 containment conditions are required when operators may be exposed to dangerous and exotic agents, which pose a high risk of aerosol-transmitted exposures to agents causing life-threatening disease for which there are no prophylactic or post-exposure treatments.

Autopsy transmitted infections may occur after direct cutaneous (percutaneous) injury, contact with droplets, or after aerosol exposure. The risk of sustaining an occupational infection transmission risk is high for blood-borne pathogens, such as those from HIV-infected bodies. Autopsy personnel are particularly at risk due to the nature of work performed on infected bodies and the high frequency of percutaneous injury through use of autopsy machinery and utensils. Infection risk is exacerbated by the high seroprevalence in certain autopsy infectious populations. In the past, autopsy personnel have died of autopsy-transmitted Marburg, Ebola and Lassa Hemorrhagic fevers.

The most efficient transmission of infections in autopsy practice is by aerosols. Infectious aerosols are composed of airborne particles approximately 1-5 microns in diameter, which can remain suspended in air for long periods of time. When inhaled, the particles traverse the upper respiratory passages and pose a significant risk for autopsy personnel.

Many tools used in autopsy contribute to the air suspension of infectious particles and it is known that all autopsies generate potentially infectious aerosols. For example, *Mycobacterium tuberculosis* is the prototypical organism transmitted by autopsy-generated aerosols. However, these aerosols can also potentially transmit other infections, including rabies, plague, legionellosis, meningococcemia, Q fever and anthrax. Personnel are also at risk of inhaling rolatized acids and converted salts such as hydrocyanic gas, unless working in a complete bio-safety area that is totally air-exhausted and air-conditioned. Autopsy workers may also be exposed to radioactive materials in a body from diagnostic procedures.

In light of the foregoing, autopsy practitioners are at significant risk of contracting a personal infection as described above, unless the required Biohazard Safety Level practice is implemented during autopsy practice.

Practitioner infections are most common in instances where autopsies are performed in remote locations and in primitive conditions, particularly where death resulting from viral hemorrhagic fevers occurs. There are, therefore, numerous situations where it is desirable to temporarily locate mobile facilities in a responsive fashion. Certain situations, such as after a natural disaster or terrorist attack involving human casualties, optimally require facilities capable of providing autopsy services in environments that meet BSL-3 and or BSL-4 practice requirements.

BACKGROUND OF THE INVENTION

Presently, very few nations are equipped with standard BSL-3 or BSL-4 autopsy facilities as each unit is expensive to build and maintain. These existing contingency facilities are housed in permanent or semi-permanent structures and cannot be moved readily to meet outbreaks of harmful chemicals, radiation or organisms in distant locations. The only facility that resembles a mobile autopsy station is the palletized mortuary supplies organized by the U.S. federal government department—DMORT. These supplies are suitable only for response to major disasters of low BSL levels, e.g. BSL-2 only. The lack of a mobile autopsy facility represents a problem in that bodies infected or suspected of being infected with harmful BSL-3 and BSL-4 agents cannot be autopsied in remote locations, where such practice is most required.

A number of mobile hospital and operating units are known.

U.S. Pat. No. 4,915,435 relates to a mobile operating compartment that is capable of invasive surgeries. Medical personnel or patients must enter directly into the preoperative/recovery area. Thus, microorganisms can enter on cloths and also as aerosol into a non-sterile area. Once inside the preoperative/recovery area, the microorganisms are able to move into the main operating compartment.

U.S. Pat. No. 4,570,733 relates to a standard cargo container reconstructed into a readily transportable hospital unit, particularly capable of airlift transportation, for providing emergency treatment to injured survivors at a site of a major disaster. There is no provision to prevent the spread of microorganisms within this facility.

U.S. Pat. No. 4,425,978 relates to a standard cargo container reconstructed into a readily transportable hospital unit, particularly capable of airlift transportation, for providing emergency treatment to injured survivors at a site of a major disaster. However, any surgeries performed therein may be contaminated by outside microorganisms.

U.S. Pat. No. 6,082,799 relates to a mobile ambulatory surgery centre vehicle for non-emergency, non-life threatening, elective surgical procedures with an aseptic operating compartment.

U.S. Pat. No. 5,964,065 relates to modular transportable field emergency medical facilities. An air filtration/conditioning system and passageway airlocks maintain positive pressure in the operating/post-operative compartments for prevention of contamination. It further includes a deployed system layout that provides efficient patient movement and avoids cross-contamination. This facility does not operate under a negative pressure system.

U.S. Pat. No. 5,711,916 relates to self-contained, transportable laboratories for the detection and quantification of contaminants in gas and liquid samples.

U.S. Pat. No. 5,775,758 relates to a portable self-contained, self-sufficient facility for the delivery of emergency care, readily transportable on the ground or by air, for a plurality of patients.

U.S. Pat. No. 6,179,358B1 relates to a mobile hospital system that can be moved by means of tractors, helicopters, railway locomotives, etc. and adapted to provide comprehensive diagnoses and medical treatments to casualties and patients. The container wagons include a surgical operation compartment with air cleaning apparatus for keeping it as a clean compartment. Further, at least one of the container wagons is tightly air-sealed and isolated from ambient air.

However, none of the above discussed prior art documents disclose a containerized, mobile facility for autopsies or examination of contaminated bodies that meet at least BSL-3 requirements.

OBJECTS OF THE INVENTION

It is an object of the present invention to provide a fully containerized, mobile autopsy facility that is capable of being transported to distant locations in order to provide autopsy facilities that meet at least BSL-3 requirements.

It is a further object of the present invention to provide for a plurality of elongated enclosures, wherein said enclosures comprise all necessary equipment and space to meet BSL-3 and -4 requirements, for use in distant contamination zones.

Other objects and advantages of the present invention will become apparent from the following description, taken in connection with the accompanying drawings, wherein, by way of illustration and example, an embodiment of the present invention is disclosed.

The present invention is intended to meet BSL-4 criteria stipulated in the "Bio-safety in Microbiological and Biomedical Laboratories" (Fourth Edition, April 1999 under Section III B, pages 47 to 53, the Laboratory Bio-safety level Criteria BSL-4 for Suit Laboratory). This is a publication by the U.S. Department of Health and Human Services, Public Health Service, Centers for Disease Control and Prevention (CDC) and National Institutes of Health (NIH). A summary of the criteria for BSL-4 facilities pertinent to this invention are as follows:

The BSL-4 facility consists of either a separate building or a clearly demarcated and isolated zone within a building. The rooms in the facility are arranged to ensure passage through the changing and decontamination areas prior to entering the room(s), where work is done with BSL-4 agents (suit area). Outer and inner change rooms separated by a shower are provided for personnel entering and leaving the suit area. A specially designed suit area is maintained in the facility to provide personnel protection equivalent to that provided by class 3 biological safety cabinets. Personnel who enter this area wear a one-piece positive pressure suit that is ventilated by a life-support system protected by high efficiency particulate air (HEPA) filtration. The life-support system includes redundant breathing air compressors, alarms and emergency backup air tanks. Entry to this area is via an airlock enclosed by airtight doors. A chemical shower is provided to decontaminate the surface of the suit before each worker leaves the area. An automatically starting emergency power source is provided at a minimum for the exhaust system, life support systems, alarms, lighting, entry and exit controls, and Biosafety Containment (BSC). The air pressure within the suit is positive to the surrounding laboratory. The air pressure within the suit area is lower than that of any adjacent area. Emergency lighting and communication systems are provided. All penetrations into the internal shell of the suit, the chemical shower and the air locks are sealed.

A daily inspection of all containment parameters (e.g. directional airflow, chemical showers) and life support systems is completed before laboratory work is initiated to ensure that the laboratory is operating according to required operating parameters.

A double-doored autoclave is provided at the containment barrier for decontaminating waste materials to be removed from the suit area. The autoclave door, which opens to the area external to the suit area, is sealed to the outer wall of the suit area and is automatically controlled so that the outside door can be opened only after the autoclave "sterilization cycle". A dunk tank, fumigation chamber, or ventilated airlock for decontamination is provided for passage of materials, supplies or equipment that are not brought into the suit area through the change room. These devices can also be used for the safe removal of materials, supplies or equipment from the laboratory that cannot be decontaminated in the autoclave.

Walls, floor and ceilings of the suit area are constructed to form a sealed internal shell, which facilitates fumigation and is animal- and insect-prohibitive. The internal surfaces of this shell are resistant to liquids and chemicals, facilitating cleaning and decontamination of the area. All penetrations into these structures and surfaces are sealed. Any drains in the floor of the suit area contain traps filled with a chemical disinfectant of demonstrated efficacy against the target agent and they are connected directly to the liquid waste decontamination system. Sewer vents and other service lines contain HEPA filters.

Internal facility appurtenances in the suit area, such as light fixtures, air ducts, and utility pipes, are arranged to minimize the horizontal surface.

A hands-free or automatically operated hand washing sink is provided in the suit area(s); hand-washing sinks in the outer and inner change rooms should be considered based on the risk assessment.

Access doors to the laboratory are self-closing and lockable. Inner and outer doors to the chemical shower and inner and outer doors to airlocks are interlocked to prevent any two doors from being opened simultaneously.

Liquid effluents from sinks, floor drains (if used), autoclave chambers and other sources within the containment barrier are decontaminated by a proven method, preferably by heat treatment, before being discharged to the sanitary sewer. Effluents from showers and toilets may be discharged to the sanitary sewer without treatment. The process used for decontamination of liquid wastes must be validated physically and biologically.

A dedicated non-recirculating ventilation system is provided. The supply and exhaust components of the system are balanced to ensure directional airflow from the area of least hazard to the area(s) of greatest potential hazard. Redundant supply fans are recommended. Redundant exhaust fans are required. The differential pressure/directional airflow between adjacent areas is monitored and alarmed so as to be able to indicate any malfunction of the system. An appropriate visual pressure-monitoring device that indicates and confirms the pressure differential of the suit area must be provided and located at the entry to the clean change room. The airflow in the supply and exhaust components is monitored and heating ventilation air conditioning (HVAC) control system is installed to prevent positive pressurization of the laboratory.

The supply air to the suit area, decontamination shower and decontamination airlock is protected by passage through a HEPA filter. The general room exhaust air from the suit area, decontamination shower and decontamination air lock is treated by a passage through two HEPA filters in series prior to discharge to the outside. The air is discharged away from occupied spaces and air intakes. The HEPA filters are located as near as practicable to the source in order to minimize the length of potentially contaminated ductwork. All HEPA filters need to be tested and certified annually. The HEPA filter housings are designed to allow for in-situ decontamination of the filter prior to removal. Alternatively, the filter can be removed in a sealed, gas-tight primary container for subsequent decontamination and/or destruction by incineration. The design of the HEPA filter housing should facilitate validation of the filter installation. The use of pre-certified HEPA filters could be an advantage. The service life of the exhaust HEPA filters can be extended through adequate pre-filtration of the supply air.

The positioning of the supply and exhaust points should be such that dead air space in the suit room is minimized.

The BSL-4 facility design and operational procedures must be documented. The facility must be tested for verification that the design and operational parameters have been met prior to operation. Facilities should be re-verified annually against these procedures as modified by operational experience.

Appropriate communication systems should be provided between the laboratory and the monitoring unit.

SUMMARY OF THE INVENTION

According to the present invention, there is provided a mobile containerized autopsy facility for use in distant contamination zones, comprising at least one enclosure which includes at least one seamless and sealable compartment, which compartment meets biohazard safety level 3 and 4 requirements.

The mobile containerized autopsy facility is preferably in the form of a standard cargo container and more preferably, comprises an exterior housing in the form of the container and having an internal enclosure therein which contains the one or more compartments. Preferably, the enclosure is a conversion of a standard 40×8×9.5 foot refrigerated cargo container.

Preferably, the internal air of each compartment is present in a negative air pressure relative to the external environment surrounding the facility. It is found to be more preferable if the internal air is treated by filtration and/or scrubbing prior to discharge to the external environment.

At least one of the compartments of the facility preferably functions as an autopsy room, which more preferably, comprises a down draft work station comprising a ventilated autopsy dissection table, wherein a down draft of exhaust air is provided to draw fumes and airborne organisms away from the source and away from the at least one operator(s). Preferably, the autopsy room further comprises a ventilated mobile autopsy trolley with a body tray to work in conjunction with the ventilated autopsy dissection table. The ventilated mobile autopsy trolley more preferably includes a perforated tray at the lower portion for the placement of instruments and samples to be carried in and out of the autopsy room.

In a preferred form of the invention, there is a second compartment that comprises at least one decontamination room. At least one of the decontamination rooms preferably provides for either or both pre- or post-operative decontamination. The pre-operative decontamination room preferably functions as a change room. More preferably, each decontamination room further comprises a chemical decontamination shower system. The post-operative decontamination room preferably includes provision for bodies or body parts after examination and discarded protective suits of the autopsy practitioners wherein said bodies or body parts and said suits are placed in double bags for subsequent disposal. More preferably, one of the compartments is an air filtration room.

Most preferably, each compartment is sealable by one or more gas tight doors, where each door is preferably operable independently of the at least one other door to ensure maintenance of negative pressure therebetween and within the compartment.

In a further preferred form of the invention, the facility further comprises connections adapted for receiving the external supply for a ventilation system, a plumbing system, an electrical supply system, an air-conditioning system and/or a waste discharge system.

In another preferred form, the external supply of ventilation, plumbing, electricity, air-conditioning and/or waste discharge is located in at least one second enclosure adapted for providing said supply to the facility. Preferably, wherein the ventilation system provides a high rate of exchange, which more preferably, includes a safe change HEPA filtration system in conjunction with a gas-phase filtration system for reducing the odour of any expelled air prior to discharge to the external environment. The ventilation and/or air-conditioning system more preferably further includes at least one self-contained breathing apparatus system to supply breathing air for the at least one suit worn by the at least one operator(s). Preferably, each enclosure further comprises a compressed breathing air-line supply to supply the at least one suit(s). The breathing apparatus system more preferably includes an air compressor and a flow monitoring system to ensure back-up air supply for said suit(s). Most preferably, the ventilation system draws the internal air of the facility from the inside of the compartment to the outside of the facility by means of an exhaust system, thereby creating a negative air pressure in the compartment. Preferably, the exhaust system further includes at least one standby fan and an auxiliary back-up power supply means.

Preferably, there is provided an integrated administration suite within the second enclosure of the facility. More preferably, each enclosure further comprises a fire protection system, a video close-circuit monitoring system, a hands-free intercom system, a processed drainage outlet, digital photographic facilities, microwave disinfecting/sterilization facilities and/or an automatic disinfectant dosing system. Preferably, each enclosure also has equipment and space necessary for veterinary medicine and animal examination, for vivisection of research animals and/or for research laboratory environment.

Most preferably, the facility of the present invention is intended to be a complete, compact and mobile BSL-3 and -4 autopsy facility, which is readily transportable by trailer or by air to remote sites and is operable independently of local infrastructure.

BRIEF DESCRIPTION OF THE DRAWINGS

By way of example only, an embodiment of the invention is described more fully hereinafter with reference to the accompanying drawings.

DETAILED DESCRIPTION OF THE INVENTION

Figure 1:
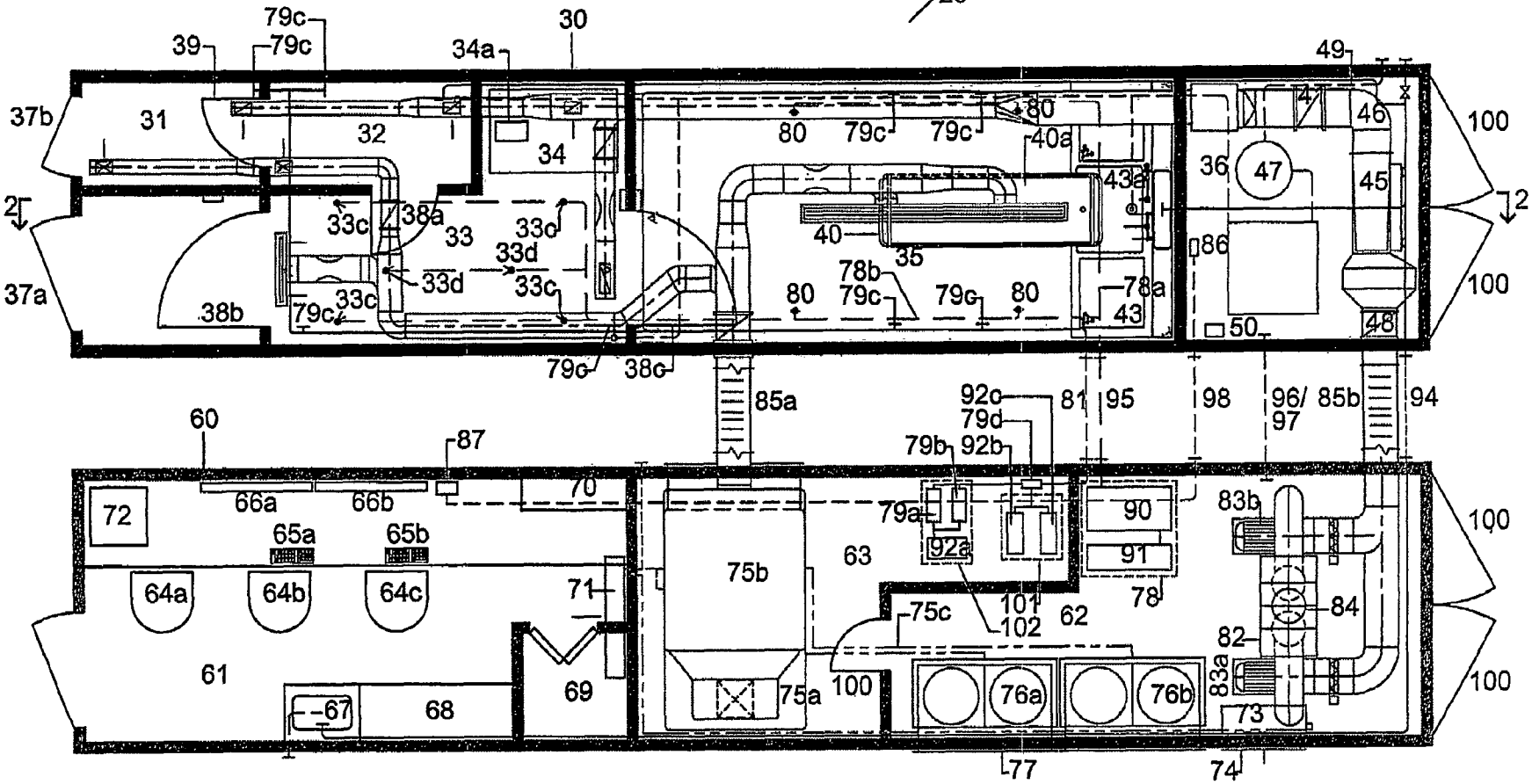
FIG. 1 shows a top plan view of a containerized autopsy facility in accordance with an embodiment of the invention.
Figure 1A:
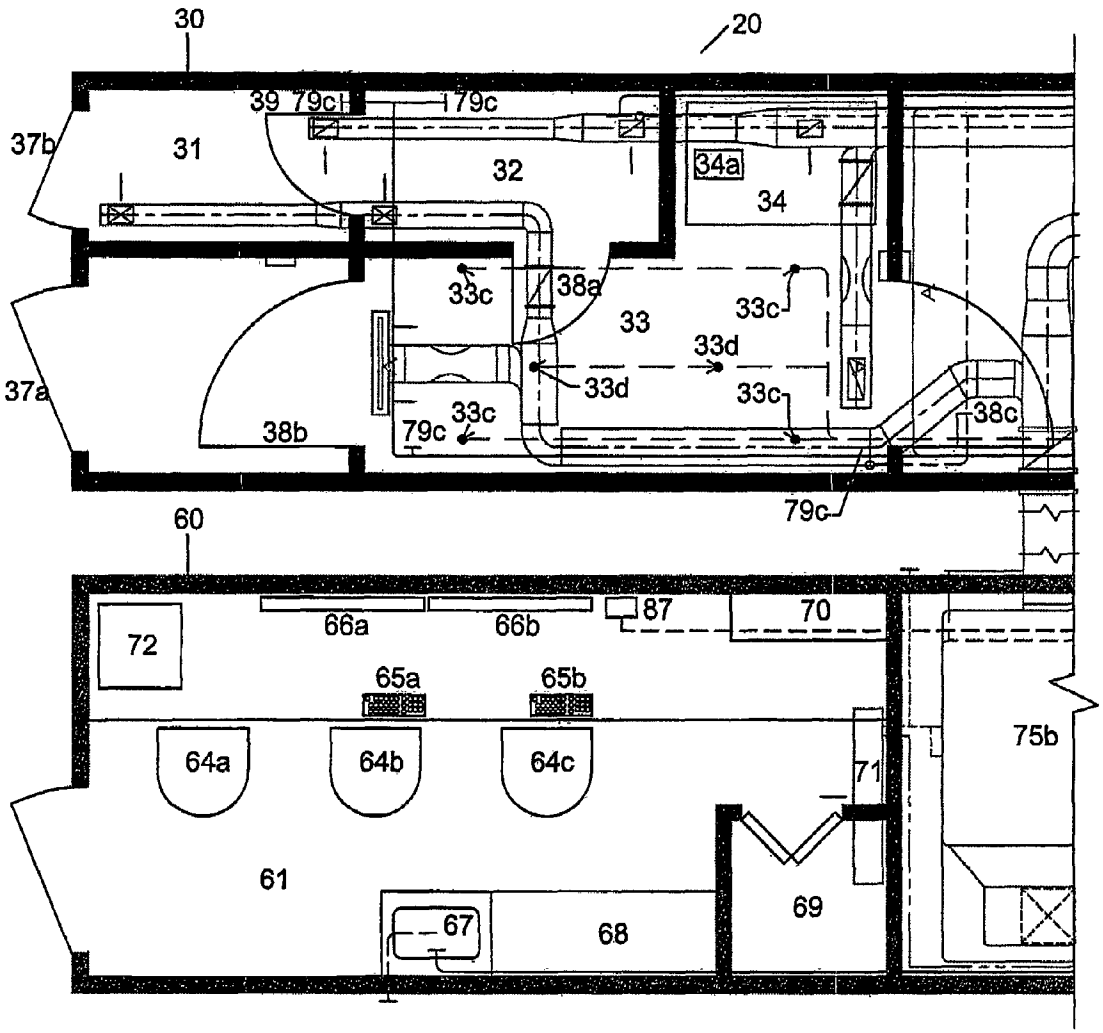
FIG. 1A shows an enlarged top plan view of a portion of the facility of FIG. 1.
Figure 1B:
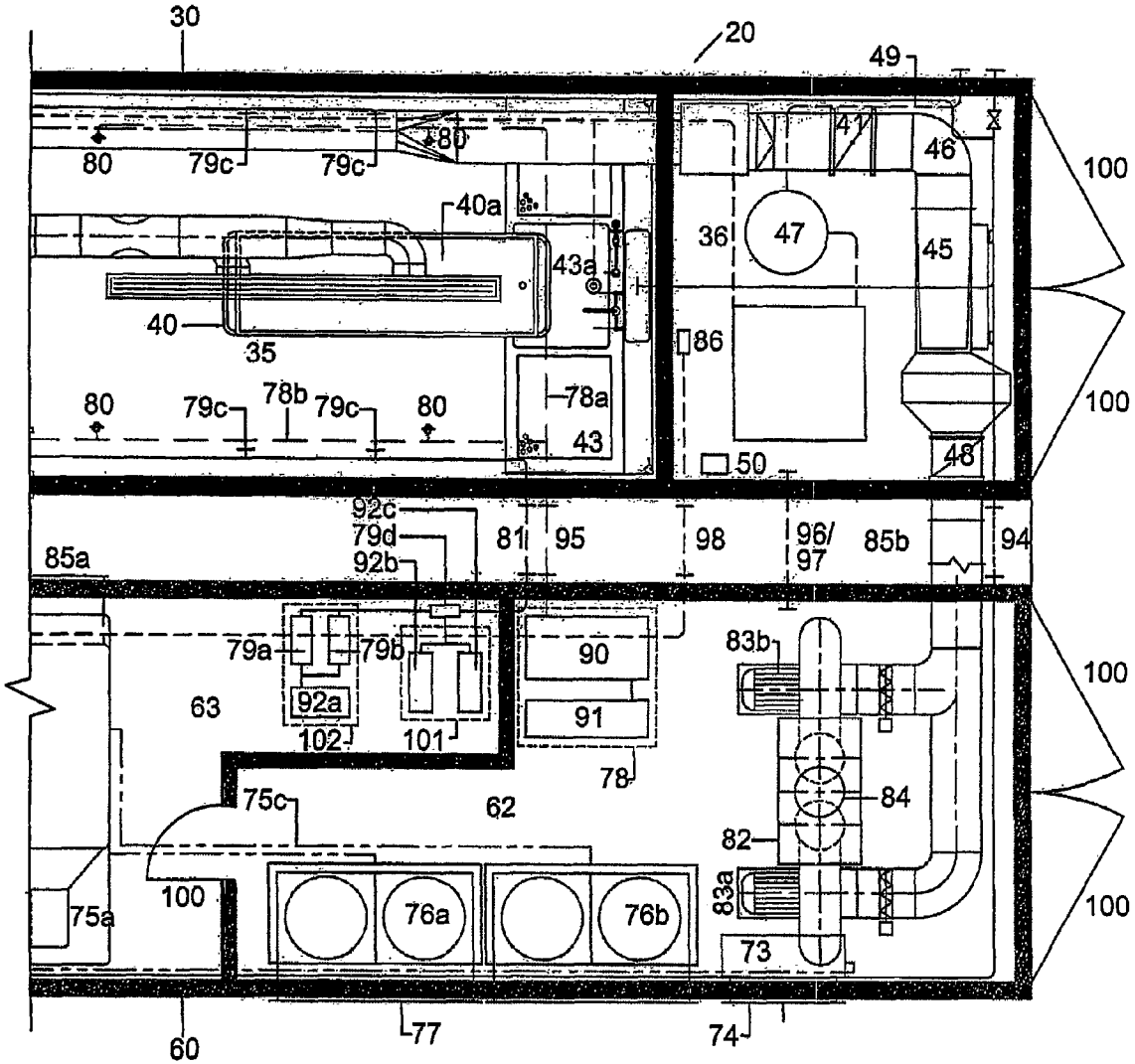
FIG. 1B shows an enlarged top plan view of another portion of the facility of FIG. 1.

FIGS. 1, 1A and 1B show a containerized autopsy facility 20. The Facility 20 comprises an autopsy container 30 and a support container 60.

The autopsy container 30 and the support container 60 are each insulated (refrigerated) containers enveloping an air-tight, sealed compartment. The autopsy container 30 and the support container 60 may vary according to needs and requirements without departing from the basis of the invention. Exemplary containers for use in the practice of this invention include, but are not limited to 20-Foot ISO containers (length of 20 ft and width of 8 ft); 40 Foot ISO containers (length of 40 ft and width of 8 ft); Super high cube containers (Oversize containers); and Air containers (containers conforming to standards laid down for air transportation). In a preferred embodiment, the autopsy container 30 and the support container 60 are of 40 ft in length×8 ft in width×9.5 ft in height.

For the autopsy container 30, a seamless and sealed compartment is formed before the installation of all essential mechanical, electrical and safety devices. The walls and floor are of stainless steel finish with epoxy coating. All services entering and exiting the autopsy container 30 are sealed and made gas tight. This configuration has the features of a "box in box" concept. The insulated (refrigerated) container forms the outer box, while another inner lining forms the inner box. This arrangement will therefore provide a double seal for the container 30, for containment purposes at BSL-4 level.

The autopsy container 30 has a changing room 31, a shower room 32, a decontamination compartment 33, comprising a microwave disinfecting/sterilization system compartment 34, an autopsy room 35 and a filter room 36. In another embodiment, the decontamination compartment 33 comprises an autoclave system.

The support container 60 compartment is formed by lining the wall, floor and ceiling with steel plates and finished with heavy-duty seamless vinyl sheets. All services entering and exiting the support container 60 are also sealed. The support container 60 has a support office 61 and plant rooms 62 and 63.

The support container 60 is designed to work in close conjunction with the autopsy container 30. Connection between the autopsy container 30 and the support container 60 is via flexible duct connectors 85*a* and 85*b*. The rest of the services which includes, compressed air pipes 81, water pipes 94, chemical dosing pipes 95, electrical wires/cables 96, CCTV cables 97, and communication system cables 98 will be interconnected between the autopsy container 30 and the support container 60 by quick-joint/de-coupling systems (not shown).

Figure 2:
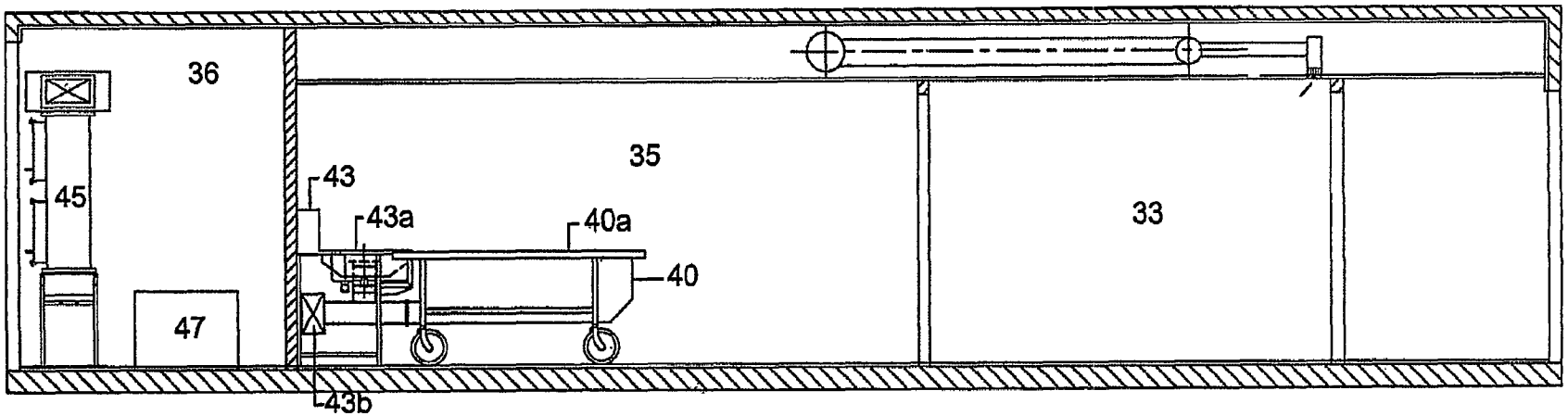
FIG. 2 shows a detailed side view of a mobile trolley and autopsy sink in accordance with a preferred embodiment of the invention.

With reference to FIG. 1 and FIG. 2, the autopsy room 35, in the autopsy container 30, is a room where autopsies are performed. It comprises a mobile autopsy trolley 40, with a body tray 40*a*, on which autopsies of the bodies will be carried out. This mobile autopsy trolley 40, with the body tray 40*a*, will also be used to transport the body, which is to be examined from the point of delivery (at a security door 37*a*) to the autopsy room 35. The body, which will be enclosed in double body bags and placed on the body tray 40*a* of the mobile autopsy trolley 40, will enter the autopsy room 35 via the security door 37*a*. It will then be pushed through a gas tight door 38*b*, which is for access to the decontamination compartment 33 and through another gas tight door 38*c*, which is for access to the autopsy room 35. The first gas tight door 38*b* must be closed before the second gas tight door 38*c* can be opened. Thereafter, the mobile autopsy trolley 40 will be parked closest to a down draft workstation 43, comprising of a sink 43*a*. The body tray 40*a* on the mobile autopsy trolley 40 will be placed to overlap the sink 43*a* so that any fluid/blood/water so collected on the body tray 40*a* will be directed to flow into the sink 43*a* and then to a drain/waste treatment system/dilution tank 47.

"Vulcathene" pipes will be used for the draining of all wastewater within the autopsy container 30. All wastewater will be routed to the dilution tank 47 and treated before being discharged to the sewer (not shown).

The down draft workstation 43 is for the dissection of body organs after they have been eviscerated from the body during the initial part of the autopsy. This down draft workstation 43 is located at the far end of the autopsy room 35 just next to the filter room 36. The purpose of the down draft workstation 43 is to provide down draft exhaust air so that any fumes or airborne organisms released during the autopsy would be drawn from the source in a downward manner away from the operators. The exhaust duct 43*b* from the down draft workstation 43 will be connected to a safe change filter 45. In particular reference to FIG. 2, there is a need for running water during the autopsy process and the sink 43*a* on the down draft workstation 43 is to facilitate this purpose.

The filter room 36 in the autopsy container 30 houses the safe-change filter 45 for the exhaust system with exhaust duct 46, a gas tight shut off damper 41. With this arrangement, all contaminated air from the autopsy container 30 will have to pass through the safe change filter 45 before being directed to a plenum box 82 for discharge at exhaust air stacks 84 in a plant room 62 in the support container 60. A gas tight shut off damper 48 ensures that in transportation mode, when the flexible connector 85*b* is not connected, no air will escape from exhaust duct 46. The safe-change filter 45 comprises HEPA filters of 99.97% efficiency at 0.3 microns, an ultra-violet light section and an activated carbon section for odor control. Magnehelic gauges will be used to monitor the HEPA filters. A formalin vaporizer dispenser 50 is installed in filter-room 36 for purposes of decontamination. This formalin vaporizer dispenser 50 can be activated remotely from a support office 61 in the support container 60. A remote transmitter and receiver 86 is installed in the filter room 36, close to where the Pathologist operates in the autopsy room 35. The remote transmitter receiver 86 will be hard-wired to an amplifier 87 in the support office 61 in the support container 60. This is to enable the Pathologist to communicate with the duty officer in the support office 61.

Inside the support container 60, the support office 61 houses a plurality of chairs 64*a*, 64*b* and 64*c*, keyboards 65*a* and 65*b*, monitor screens 66*a* and 66*b*, a washing basin 67, a locker 68, a changing room 69, a cabinet 70, a wall mounted air conditioning unit 71 and a tabletop refrigerator 72. The support office 61 is connected to the autopsy room 35 by a CCTV system (not shown) for monitoring of autopsy services and also to keep watch on the safety of the Autopsy personnel during the autopsy process.

The plant-room 62 houses a condensing unit 73 for the wall-mounted air-conditioner 71 and a condenser discharge air duct 74. It also houses two condensing units 76*a* and 76*b* for the first stage pre-cooled air conditioner (AHU1) 75*a* and a second stage air-cooled split type air-conditioner (AHU2) 75*b*, and a hot air duct 77 to expunge hot air. Exhaust air fans 83*a* and 83*b*, a dosing station 78, which comprises an atomizer 90 and an air compressor 91, which is connected to the dosing pipes 78*a* and 78*b* in the autopsy container 35 for purposes of spraying disinfectant are also housed in plant room 62. The plant room 63 houses AHU1 75*a* and AHU2 75*b*, two self-contained breathing apparatus (SCBA) systems 101 and 102 and their related air compressors 92*a*, 92*b* and 92*c*.

The SCBA system 101 is a self-contained breathing air system, which is designed to supply breathing air to the autopsy container 30 for air suits that are worn by autopsy personnel in a BSL-4 environment. The breathing air is supplied by two compressors 92*b* and 92*c* in the plant room 63 in the container 60 to the SCBA air-lines connector 79*c* in the autopsy container 30. The compressors 92*b* and 92*c* act as backups for each other. In the event of one compressor 92*b* failing, another compressor 92*c* will automatically come into operation and vice-versa. In the event of failure of compressors 92*b* and 92*c*, another SCBA system 102, which comprises the scuba compressor 92*a*, and two scuba tanks 79*a* and 79*b* will then be automatically activated. The air from these two compressed air systems has to pass through a flow monitoring system 79*d* before being distributed to the SCBA air-lines. In this way, there is a 100% back up for the SCBA for the air suits. When the SCBA is in operation, autopsy personnel may plug into the pressurized air supply at convenient strategic points.

In use, the air-conditioning system of the autopsy container 30 is designed to provide 20-25 air changes within the critical negative air pressure environments, namely the autopsy room 35 and the decontamination compartment 33. The air-conditioning system is controlled within the plant room 63 and provides 100% fresh air to be drawn from the atmosphere via an intake grille (not shown) on the exterior of the support container 60. This 100% fresh air will pass through a series of pre- and HEPA filters before being drawn into an air-cooled split type pre-cooled air-conditioner 75*a* and 75*b*. The first stage pre-cool air-conditioner (AHU1) 75*a* will cool the fresh air before it is passed to a second stage air-cooled split type air-conditioner (AHU2) 75*b*. The second stage air-conditioner 75*b* is for conditioning and cooling of the first stage air before it is supplied to the conditioned space. Thus, all fresh air is HEPA filtered and conditioned prior to entering the conditioned space. The condensing units 76*a* and 76*b* are interconnected to the fan coil unit of the air-cooled split type pre-cooled air conditioners, 75*a* and 75*b* by refrigerant pipes 75*c* and the condensing air is discharged via hot air duct 77 on one side of the support container 60, away from the supply air intake.

The air-conditioning system is designed such that the air-conditioners will only operate when the exhaust system is operating. This is to prevent the positive pressurization of either of the negative pressure compartments. The control and alarm systems are connected to pressure gauges to monitor this pressure control system. Within the autopsy room 35, specially designed ducts to the safe change filter 45 connect exhaust ducts from the down draft work station 43 and the mobile autopsy trolley 40.

The exhaust air from the autopsy container 30 is drawn through the safe change filter system 45 in the filter room 36 by an exhaust fan, either 83*a* or 83*b* in the plant room 62. Two exhaust fans 83*a* and 83*b* are installed, with one as a 100% standby unit for the purpose of exhausting air. Should the duty fan fail, the standby fan will be initiated. Each exhaust fan 83*a*, 83*b* has an exhaust duct to the removable exhaust air stack 84 to discharge the cleaned up exhaust air. By drawing exhausting air in this manner, a negative pressure is created in the autopsy room 35 as well as in the decontamination compartment 33.

The decontamination compartment 33 is a critical area that is maintained at a negative pressure. This compartment is used for the decontamination of bodies (in double bags) after post-mortem examination and thereafter by autopsy personnel for the decontamination of suits. Decontamination spray outlets 33*c* are provided within the decontamination compartment 33. The nozzles on the spray outlets 33*c* are designed to cover the angle of spray for the post-mortem bodies (in double bags) in one mode of operation and then for the decontamination of the Pathologist and his or her assistant in air suits after the post-mortem in another. The dosing station 78 in the plant room 62 services the atomizing decontamination system used in the decontamination compartment 33 as well as the autopsy room 35 in the autopsy container 30. Atomizer spray guns (not shown) are used for disinfecting and decontamination purposes in the autopsy room 35.

Container doors 100 are always closed during all autopsy and general laboratory work. Each door is opened only to access the filter room 36 and plant room 62 and plant room 63 for maintenance of equipment and instruments as necessary.

There will be provision for a standby independent diesel generator set outside the autopsy container 30 (not shown). This will be a stand-alone generator set on a skid with a sound attenuation system. This generator set will be designed to cater for all the electricity supply that both the autopsy container 30 and the support container 60 will require. In the event that temporary power supply is available at site, the generator set will be put on a standby mode.

Before the commencement of each autopsy session, the autopsy attendants will bring all instruments/equipment for cutting and dissection during the autopsy into the autopsy room 35. Hence, there is no need for any storage cabinets within the autopsy room 35. Some of the instruments/equipment may also be placed on the perforated shelf at the lower portion of the mobile trolley 40 accompanying the body into the autopsy room.

The autopsy assisting attendants, after preparing all equipment and instruments for the autopsy, will then wheel in the body to be autopsied on the body tray 40*a*, which is on the mobile autopsy trolley 40, to position in the autopsy room 35. The attendants, who should have donned the appropriate personal protection equipment (PPE), will enter the autopsy container 30 with the body by the security door 37*a*. They will then pass through the gas tight door 38*b*, which they will have to close before opening another gas tight door 38*c* to gain access to the autopsy room 35. When the body on the body tray 40*a* placed on the mobile autopsy trolley 40 is in position, the autopsy assisting attendants will the leave the autopsy room 35. They should leave by the same procedure as they enter, through the gas tight door 38*c*, another gas tight door 38*b* and then the security door 37*a*, closing each door behind them. The autopsy room 35 is now ready for the Pathologist and his or her assistant to enter.

The Pathologist and his or her assistant change into their "scrubs" in the changing room 69 in the support container 60. They will enter the autopsy container 30 through the security door 37*b* into the changing room 31. They will then don PPE and the appropriate BSL 4 suits in the changing room 31. Prior to donning the air suit, the pathologist will be hooked up with a hands-free intercom set (not shown), comprising a hands-free microphone and a headphone (with a transmitter/receiver), to allow the pathologist to communicate with the duty officer in the support office 61. The Pathologist and his or her assistant, properly attired, enter the shower room 32 through door 39. They then enter the decontamination compartment 33, through the gas tight door 38*a*. In a BSL 4 environment, a positive pressure air suit is required. This is to prevent personnel from coming into contact with any deadly viruses. The aforesaid type of pressure suits has a sealed closing system, an internal air control distribution system, a HEPA filter and a pair of boots attached to the suit. The exhaust air for the suit is through two magnetic valves. This suit is made of fabric-backed polyvinyl chloride (PVC) assembled by high frequency welding designed not to be detrimental to the properties of the PVC. The suit is reusable.

Once the suit is put on, the Pathologist and his assistant will have about 5 minutes of breathing air before hooking on to an air supply source. He will have to close the gas tight door 38*a* after entering the decontamination compartment 33. Next, he will hook on his air supply to the SCBA line connector 79*c* in the decontamination compartment 33 for his air pressure suit. His assistant will follow the same procedure to get into the decontamination compartment 33.

The Pathologist and his or her assistant are now ready to enter the autopsy room 35. Once both the pathologist and his or her assistant enter the autopsy room 35, they must close the gas tight door 38*c*. Both the Pathologist and his assistant will now hook their air-lines onto to the SCBA line connector 79*c* in the autopsy room 35. They are now ready to perform the autopsy.

For the purposes of maintaining flow of entry to and exit from the autopsy room 35, all three gas tight doors, 38*a*, 38*b* and 38*c* are interlocked in such a way, that only one of them will be allowed to open at a time. This interlock arrangement will also facilitate the maintenance of negative pressure between the autopsy room 35 and the decontamination compartment 33. This arrangement will further facilitate the process of the decontamination of bodies and personnel within the decontamination compartment 33.

The Pathologist and his or her assistant will then remove both the double body bags, (which were used to seal the body for transportation) in order to examine the body. The assistant will then transfer the used body bags to a biohazard disposal bag and then seal up the bag securely. This sealed biohazard disposal bag with its contents is to be put into another biohazard disposal bag, which is also to be securely sealed. The used body bags will now be securely sealed in double biohazard bags and will now be put aside in the autopsy room 35. The Pathologist and his assistant will proceed with the autopsy of the body.

During the autopsy, internal and external examination will be carried out. This will include sampling of materials for testing and analysis. When the Pathologist and his or her assistant have finished with the autopsy process, the body will first be cleaned and decontaminated. It will then be placed in a body bag. The external surface of the bag will then be decontaminated and another bag will then be applied. Similarly, the samples collected will be placed in a sealed container. The external surface of the sealed container will then be decontaminated before placing it into another sealed container. These, plus double body bag, the used body bags, which were sealed in double biohazard disposal bags, and the instruments/equipment used will have to be decontaminated before they are moved out of the autopsy room 35. The Pathologist and his assistant will hook up atomizer spray guns (not shown) to the decontamination spray gun connector 80 to spray disinfectant onto the body bag and the body tray 40*a* on the mobile autopsy trolley 40. With particular reference to FIG. 2, the body (sealed in double body bags) on the body tray 40*a* and the mobile autopsy trolley 40 plus the samples collected within sealed containers will then be wheeled out through the gas tight door 38*c* by the Pathologist's assistant to decontamination compartment 33 and placed in the marked decontamination position.

The instruments/needles/sharps used during the autopsy will be collected in special boxes. These are to be placed directly in a microwave container 34*a* and the rest of the waste/tissues/parts will be placed in biohazard disposal bags for processing in the microwave waste disinfecting and sterilization system 34 in the decontamination compartment 33. Once the body on the body tray 40*a* and the mobile autopsy trolley 40 are in the decontamination position, the Pathologist's assistant will close the gas tight door 38*c* and re-enter the autopsy room 35. He can then start the decontamination cycle. In another embodiment, the decontamination cycle is activated via the support office 61.

Disinfectant sprays 33*c* will be activated when the decontamination process in the decontamination compartment 33 starts. The Pathologist and his or her assistant will remain in the autopsy room 35 to continue the decontamination of the area with the atomizer guns (not shown). When the decontamination cycle for the body ends, the autopsy assisting attendants will be called through the intercom system. The autopsy assisting attendants (who have donned the appropriate PPE) will then wheel a biohazard container with a fresh disposal bag into the decontamination compartment 33 via security door 37*a* and gas tight door 38*b*. The decontaminated double biohazard bags, which contain the used body bags, will then be placed in a fresh biohazard disposal bag and then tied up securely by the autopsy assisting attendants. He will then place these triple biohazard disposal bags into the biohazard container. One of the autopsy assisting attendants will then wheel the used body bags, which are now in triple biohazard disposal bags in the biohazard container, away for proper disposal. He will leave by gas tight door 38*b* and then security door 37*a* closing each door behind him. The other autopsy assisting attendant will then remove the body on the body tray 40*a*, which is on the mobile trolley 40 from the decontamination compartment 33 via the gas tight door 38*b* and security door 37. In the interim, the Pathologist and his assistant will gather up all the wastes for disposal and bag them in double biohazard bags.

Once the gas tight door 38*b* is closed, the Pathologist and his assistant can open the other gas tight door 38*c* to gain access to the decontamination compartment 33. They will now stand in specially marked positions. Another set program of disinfectant spray 33*d* will be initiated to operate to decontaminate them.

When the decontamination cycle is over, the exhaust air cycle will start. After a programmed number of air changes in decontamination compartment 33 has taken place, and when it is deemed safe, the Pathologist will remove his air suit, open the gas tight door 38*a* and move into the shower room 32 in his "scrubs". He will then take a shower and change into new scrubs in the changing room 31 before leaving the container 30 via the security door 37*b*. His assistant will then follow this same procedure to exit the autopsy container 30.

When the microwave cycle is completed in the microwave disinfecting/sterilization system 34, an indicating light with a buzzer (not shown) will be activated in the support office 61. The autopsy assisting attendants will then gain access to the decontamination compartment 33 and then open up the door to the microwave disinfecting/sterilization system 34 to remove the microwave bags for disposal at proper disposal centers. The autopsy assisting attendants will also remove the decontaminated air suits for further cleaning.

The microwave disinfecting/sterilization system 34 provides for the disinfecting and sterilization of biomedical waste for later disposal. It is also used for disinfecting the instruments used during the postmortem. All waste-water from the sinks and floor traps of the autopsy container 30 is collected at a common point in the dilution tank 47, and treated before being discharged into the sewer lines 49.

The embodiment of the present invention may vary depending on the application. Exemplary application for use in the practice of the invention include, but are not limited to veterinary medicine and animal examination, vivisection of research animals and research laboratory environment.

While this invention has been described in connection with specific embodiments thereof, it will be understood that it is capable of further modification(s). This application is intended to cover any variations, uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof.

The invention claimed is:

1. A mobile containerized autopsy facility for use in distant contamination zones, comprising at least one enclosure which includes at least one seamless and sealable compartment, which compartment meets biohazard safety level 3 and 4 requirements.

2. The mobile containerized autopsy facility according to claim 1, wherein the facility is in the form of a standard cargo container.

3. The mobile containerized autopsy facility according to claim 1, wherein the facility comprises an exterior housing in the form of the container and having an internal enclosure therein which contains the compartment or more compartments.

4. The mobile containerized autopsy facility according to claim 1, wherein the internal air of the compartment or each compartment is present in a negative air pressure relative to the external environment surrounding the facility.

5. The mobile containerized autopsy facility according to claim 4, wherein the internal air is treated by filtration or scrubbing prior to discharge to the external environment.

6. A mobile containerized autopsy facility according to claim 1, wherein at least one of the compartments is an autopsy room.

7. The mobile containerized autopsy facility according to claim 6, wherein the autopsy room further comprises a down draft work station comprising a ventilated autopsy dissection table, wherein a down draft of exhaust air is provided to draw fumes and airborne organisms away from a source and away from the at least one operator.

8. The mobile containerized autopsy facility according to claim 7, wherein the autopsy room further comprises a ventilated mobile autopsy trolley with a body tray to work in conjunction with the ventilated autopsy dissection table.

9. The mobile containerized autopsy facility according to claim 8, wherein the ventilated mobile autopsy trolley includes a perforated tray at the lower portion for the placement of instruments and samples to be carried in and out of the autopsy room.

10. A mobile containerized autopsy facility for use in distant contamination zones according to claim 1, wherein there is a second compartment that comprises at least one decontamination room.

11. A mobile containerized autopsy facility according to claim 10, wherein the at least one decontamination room provides for either or both pre-operative decontamination or post-operative decontamination.

12. A mobile containerized autopsy facility according to claim 11, wherein the pre-operative decontamination room functions as a change room.

13. The mobile containerized autopsy facility according to claim 11, wherein the decontamination room or each decontamination room further comprises a chemical decontamination shower system.

14. The mobile containerized autopsy facility according to claim 11, wherein the said postoperative decontamination room includes provision for bodies or body parts after examination and discarded protective suits of the autopsy practitioners wherein said bodies or body parts and said suits are placed in double bags for subsequent disposal.

15. A mobile containerized autopsy facility according to claim 1, wherein one of the compartments is an air filtration room.

16. The mobile containerized autopsy facility according to claim 1, wherein the compartment or each compartment is sealable by one or more gas tight doors.

17. The mobile containerized autopsy facility according to claim 16, wherein the door or each door is operable independently of at least one other door to ensure maintenance of negative pressure therebetween and within the compartment.

18. The mobile containerized autopsy facility according to claim 1, wherein the facility further comprises connections adapted for receiving external supply for one or more systems selected from the group consisting of a ventilation system, a plumbing system, an electrical supply system, an air-conditioning system, and a waste discharge system.

19. The mobile containerized autopsy facility according to claim 18, wherein said connections comprise quick de-coupling systems.

20. The mobile containerized autopsy facility according to claim 18, wherein the external supply of said ventilation, plumbing, electricity, air-conditioning or waste discharge system is located in at least one second enclosure adapted for providing said supply to the facility.

* * * * *